US006260338B1

(12) United States Patent
Wheeler

(10) Patent No.: US 6,260,338 B1
(45) Date of Patent: Jul. 17, 2001

(54) EQUINE RESTRAINT AND TRAINING DEVICE

(76) Inventor: Raymond C. Wheeler, Rte. -190 2, Box 26A, Ellendale, MN (US) 56026

( * ) Notice: Subject to any disclaimer, the term of this patent is extended or adjusted under 35 U.S.C. 154(b) by 0 days.

(21) Appl. No.: 09/468,204

(22) Filed: Dec. 20, 1999

Related U.S. Application Data

(63) Continuation-in-part of application No. 09/177,891, filed on Oct. 23, 1998, now Pat. No. 6,058,686, and a continuation of application No. PCT/US96/15095, filed on Sep. 20, 1996.

(60) Provisional application No. 60/016,636, filed on Apr. 25, 1996.

(51) Int. Cl.[7] ..... B68B 1/00

(52) U.S. Cl. ..... 54/71

(58) Field of Search ..... 54/71, 6.1, 24, 54/6.2, 7, 8; 119/800, 712, 797

(56) References Cited

U.S. PATENT DOCUMENTS

| | | | |
|---|---|---|---|
| 233,631 | 10/1880 | Magner . | |
| 437,867 | 10/1890 | O'Connor . | |
| 474,739 | 5/1892 | Hollingsworth . | |
| 751,006 | 2/1904 | Poe . | |
| 804,700 | 11/1905 | Bethe . | |
| 815,424 | 3/1906 | Halliburton . | |
| 843,689 | 2/1907 | McClintock . | |
| 985,642 | 2/1911 | Tallman . | |
| 1,209,724 | 12/1916 | Koepke . | |
| 1,351,620 | 8/1920 | Canter . | |
| 2,804,741 | 9/1957 | Cheesebro . | |
| 3,657,863 | 4/1972 | Blair . | |
| 4,214,420 * | 7/1980 | Ferree | 54/35 |
| 4,941,312 | 7/1990 | Old, Sr. . | |

FOREIGN PATENT DOCUMENTS

| | | |
|---|---|---|
| 357924 | 9/1922 | (DE) . |
| 0 018 915 | 11/1980 | (EP) . |
| 340944 | 7/1904 | (FR) . |
| 2 396 721 | 2/1979 | (FR) . |
| 3798 | 9/1892 | (SE) . |

OTHER PUBLICATIONS

Jeffers Equine Catalog, Fall 1999, p. 39.
K. V. Vet Catalog, 1999, p. 214.
TWITCH–NOT™ product brochure (date unknown).
TWITCH–NOT™ web page http://.homtown.com/twitch–not/main.htm (date unknown).

* cited by examiner

*Primary Examiner*—Charles T. Kordan
*Assistant Examiner*—Yvonne R. Abbott
(74) *Attorney, Agent, or Firm*—Richard C. Litman

(57) ABSTRACT

An equine restraint system which allows a single person to control a horse while performing tasks such as leading, holding, saddling, or loading the horse. The restraint system has a portion that fits behind the horse's ears and a portion that fits under the horse's upper lip. The restraint system has a single cord which can be pulled to simultaneously apply pressure behind the horse's ears and under the horse's upper lip.

5 Claims, 2 Drawing Sheets

EQUINE RESTRAINT AND TRAINING DEVICE

CROSS-REFERENCE TO RELATED APPLICATIONS

This application is a continuation-in-part of U.S. patent application Ser. No. 09/177,891, filed on Oct. 23, 1998, now U.S. Pat. No. 6,058,686 which is a continuation of International Patent Application Number PCT/US96/15095, filed on Sep. 20, 1996, which claims the benefit of the priority of U.S. Provisional application Ser. No. 60/016,636, filed on Apr. 25, 1996.

BACKGROUND OF THE INVENTION

1. Field of the Invention

The present invention relates to a restraint and training device for controlling the behavior of a horse or the like in order to obtain the compliance of the animal while performing activities that may involve some discomfort to the animal or while training the animal.

2. Description of the Related Art

Frequently, it is necessary to perform operations on an animal such as a horse, donkey, mule, or the like, that involve some discomfort to the animal. Such operations include saddling, vaccinating, loading and unloading the animal on and off a vehicle, drawing blood samples, shoeing, introducing a young horse to saddle and bridle, etc. In addition, during training of an animal, the animal may have to be put through training routines that may involve great exertion or that may not be particularly pleasant for the animal. During such operations the animal may become agitated and may react violently causing injury to itself and to bystanders. To date devices known as "twitches" have been used to restrain an animal while performing activities that may involve some discomfort to the horse. These conventional devices require at least two people to operate the devices successfully, unlike the present invention which can be operated by one person. Further, twitches pinch the animal's upper lip and cause pain to the animal. In fact twitches cause so much discomfort to the animal that, after the first few times the twitch is applied to the animal, the animal will begin to strenuously resist the application of the twitch to it's upper lip. In addition to the conventional twitches, other devices have been proposed in the prior art which put pressure on the regions behind a horse's ears and under the horse's upper lip to control the horse's behavior. However, none of the prior art devices provide the degree of adjustability, convenience, and safety of the present invention. Further, none have the unique structural features of the present invention.

U.S. Pat. No. 233,631, issued to Dennis Magner on Oct. 26, 1880, shows a bridle having a bit. A chain is connected to the bit which fits under the upper lip of the horse. The Magner device does not allow pressure to be applied to the region under the horse's upper lip independently of the pressure applied to the corners of the horse's mouth by the bit.

U.S. Pat. No. 437,867, issued to Peter O'Connor on Oct. 7, 1890, shows a restraint device that puts pressure on the region of the horse's upper lip. The O'Connor device does not use a single continuous cord as in the present invention. Further, the O'Connor device lacks the double barrel sleeve and the double pulley of the present invention.

U.S. Pat. No. 474,739, issued to Gibson R. Hollingsworth on May 10, 1892, shows a bridle for applying pressure to a horse's mouth by pulling on a single cord. The Hollingsworth device does not apply pressure to the region under the horse's upper lip.

U.S. Pat. No. 751,006, issued to Henry H. Poe on Feb. 2, 1904, shows a bridle having a system of pulleys for controlling the application of pressure to a bit. The Poe device does not apply pressure to the region under the horse's upper lip.

U.S. Pat. No. 804,700, issued to August L. Bethe on Nov. 14, 1905, shows a pivoting bit for a horse. The Bethe device does not apply pressure to the region under the horse's upper lip.

U.S. Pat. No. 1,351,620, issued to Samuel C. Canter on Aug. 31, 1920, shows a combination bridle and halter. The Canter device does not apply pressure to the region under the horse's upper lip.

U.S. Pat. No. 4,941,312, issued to Ralph N. Old, Sr. on Jul. 17, 1990, shows a bit having a chain that passes under the horse's lower jaw. The Old device does not apply pressure to the region under the horse's upper lip.

Swedish Patent Document Number 3798, by K. J. Petterson dated Sep. 14 1892, shows a bridle having a bit. A chain is connected to the bit which fits under the upper lip of the horse. The Petterson device does not allow pressure to be applied to the region under the horse's upper lip independently of the pressure applied to the corners of the horse's mouth by the bit.

European Patent Document Number 0 018 915, by Eric Le Tixerant dated Nov. 12, 1980, shows a bridle having pulleys for controlling the application of pressure to a bit. The Le Tixerant device does not apply pressure to the region under the horse's upper lip.

None of the above inventions and patents, taken either singly or in combination, is seen to describe the instant invention as claimed.

SUMMARY OF THE INVENTION

The present invention is directed to an equine restraint system or device which can be operated by a single person while allowing that person to carry out tasks such as leading, holding, saddling, and loading of the horse. The restraint system of the present invention has a portion that fits behind the horse's ears and a portion that fits under the horse's upper lip. The restraint system of the present invention has a single cord which can be pulled to simultaneously apply pressure behind the horse's ears and under the horse's upper lip. Application of pressure to these areas has a calming affect on the horse, allowing various activities to be performed on the horse.

Accordingly, it is a principal object of the invention to provide an equine restraint system which simultaneously puts pressure on the nerve centers behind a horse's ears and under the horse's upper lip.

It is another object of the invention to provide an equine restraint system that can be operated by a single person.

It is a further object of the invention to provide an equine restraint system that can be adjusted in size easily.

Still another object of the invention is to provide an equine restraint system which reduces the possibility of injury to the horse and/or bystanders.

Yet another object of the invention is to provide an equine restraint system which is convenient and easy to use.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
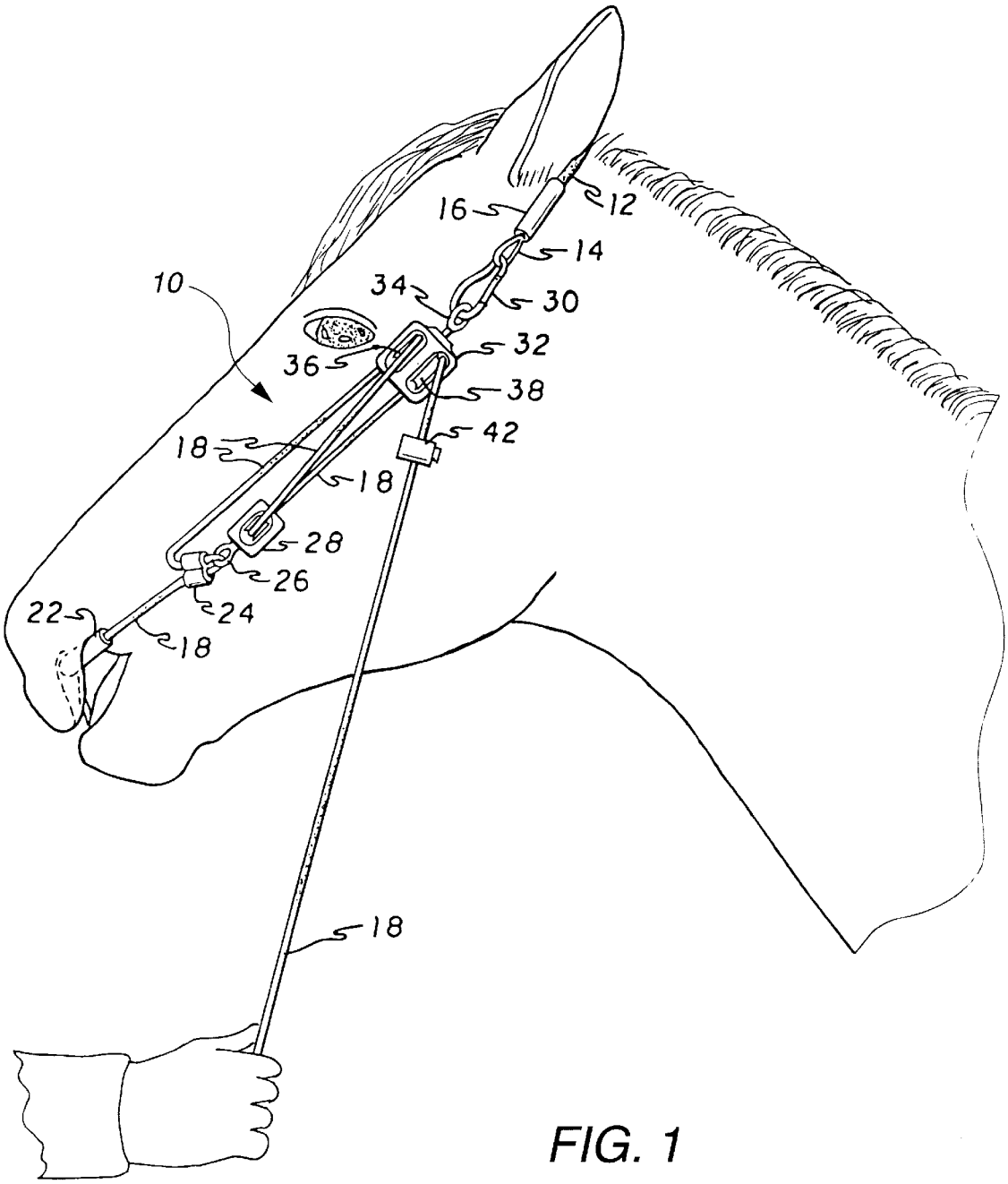
FIG. 1 is an environmental view showing the equine restraint system of the present invention in position on a horse's head.
Figure 2:
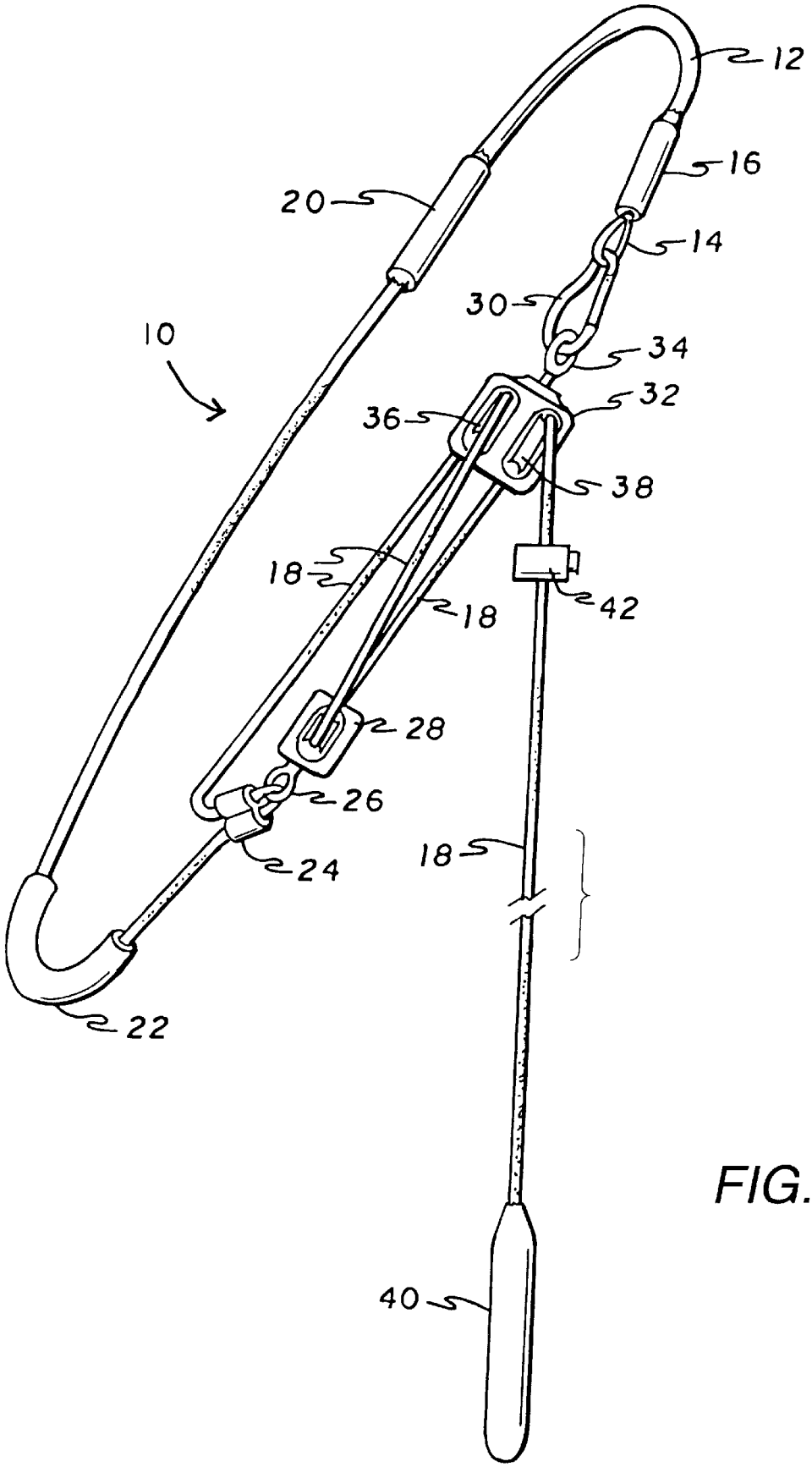
FIG. 2 is a perspective view showing details of the equine restraint system of the present invention.

Referring to FIGS. 1 and 2, the present invention is an equine restraint system 10 used for calming a horse while performing various tasks involving the horse. These tasks include, for example, breeding, drawing blood, hot walking, ponying, tubing, clipping, driving, loading, saddling in paddock, vaccinations, deworming, floating teeth, medicating, shoeing, and wound doctoring.

Fundamentally, the present invention is an equine restraint system or device which can be operated by a single person while allowing that person to carry out tasks such as those enumerated above. The restraint system of the present invention has a portion that fits behind the horse's ears and a portion that fits under the horse's upper lip. The restraint system of the present invention has a single cord which can be pulled to simultaneously apply pressure behind the horse's ears and under the horse's upper lip. Application of pressure to these areas has a calming affect on the horse, allowing various activities to be performed on the horse. Once the appropriate pressure has been applied to the animal's head, a cord stop is used to keep constant pressure behind the animal's ears and under the animal's upper lip, without the need for the user to constantly keep hold of the cord used to apply pressure between the two portions of the device of the present invention. The portion that fits under the animal's upper lip may be provided with a non-abrasive outermost surface to prevent cuts and abrasions to the horse's upper lip and gum.

The restraint 10 includes a plastic coated cable 12 which is intended to rest on the poll of the horse's head (the area just behind the ears). One end of the cable 12 is formed into a loop 14 and crimped back on itself. The region of the crimp, adjacent loop 14, is covered by a heat shrinkable plastic tube 16. The tube 16 covers any sharp edges or projections that may be a source of irritation to the horse. The other end of the cable 12 is attached to the end of a cord 18 by crimping or any other well known means. Again, the attachment of the cable 12 to the cord 18 is covered by a heat shrinkable plastic tube 20 in order to cover any sharp edges or projections that may be a source of irritation to the horse.

It is a portion of the cord 18 which forms the portion of the device 10 that fits under the animal's upper lip. The cord 18 passes through clear plastic tubing 22 whose function is explained below. After passing through the plastic tubing 22, the cord 18 passes through an aluminum sleeve 24. The sleeve 24 may be of a double barrel configuration or otherwise have a cross section that can accommodate two portions of the cord 18 placed side by side. As an example, the sleeve 24 may have a bicuspid cross section or a cross section resembling two slightly overlapping circles, each circle being large enough to accommodate the diameter of the cord 18. After passing through the plastic tubing 22, the cord 18 passes through a first barrel or side of the aluminum sleeve 24. Thereafter, the cord 18 passes through the eye of a swivel 26 attached to a single pulley 28. The cord 18 then passes back through the second barrel or side of the sleeve 24.

Attached to the loop 14 is a snap hook 30 having a pivoting latch. The snap hook 30 releasably attaches a double pulley 32 to the loop 14. The double pulley 32 has a swivel 34 through which the snap hook 30 passes. Also, the double pulley 32 has a first pulley 36 and a second pulley 38 which are positioned side by side and rotate about the same axis.

After passing through the second barrel or side of the sleeve 24, the cord 18 passes around the first pulley 36 of the double pulley 32. Then the cord 18 passes around the single pulley 28, after which the cord 18 continues back toward the double pulley 32. Then the cord 18 passes around the second pulley 38 of the double pulley 32, after which the cord 18 continues for a predetermined length until finally terminating in the handle 40.

A spring loaded, movable cord stop 42 is provided on the portion of the cord 18 extending between the double pulley 32 and the handle 40. The cord stop 42 is of the type having a button slidably supported by the bore of an outer sleeve. The button has a hole therethrough which can be made to register with a pair of holes in the outer sleeve of the stop 42, when the button is properly positioned relative to the outer sleeve of the stop 42. A spring housed within the outer sleeve of the stop 42, tends to push the button outward thus causing the hole through the button to go out of alignment with the holes in the outer sleeve. With the cord 18 passing through both the hole through the button and the holes in the outer sleeve of stop 42, spring pressure pushes the hole through the button out of alignment with the holes in the outer sleeve, thus pinching the cord 18 between the button and the outer sleeve. The cord stop 42 is thus frictionally fixed to the cord 18. To reposition the cord stop 42, the button of the cord stop 42 is depressed bringing the hole through the button into alignment with the holes in the outer sleeve of the cord stop 42. This action releases the frictional force on the cord 18, allowing the cord stop 42 to be slidably moved along the cord 18. Once the cord stop 42 has reached the desired location on the cord 18, the button is released fixing the cord stop 42 at the new location. The construction of the cord stop 42 is well known and therefore the details of the construction of the cord stop 42 are not shown in the accompanying illustrations.

The handle 40 is tubular and is made from a piece of plastic that is molded to have inter-digital protrusions which afford a better grip to a user grasping the handle 40. One end of the handle 40 has a narrow opening that is just big enough for the cord 18 to pass therethrough. The other end of the handle 40 has a wide opening. The cord 18 is passed through the narrow opening of the handle 40 and then the end of the cord 18 is tied in a knot (not shown) in order to attach the handle 40 to the cord 18. This construction results in a light weight and relatively soft handle. The lightness and softness of the handle 40 are desirable features, since a heavier and/or harder handle can cause injury to the horse or a bystander if the horse violently swings its head as horses are apt to do on occasion.

FIG. 1 shows the restraint system 10 in use. To mount the restraint 10 to the horse's head, the cord stop 42 must first be moved toward the handle 40 by depressing the button of the cord stop 42 and sliding the cord stop down toward the handle 40. This step will allow some slack in the restraint system 10 while placing the restraint system 10 on the horse's head.

At this time the user must ensure that the plastic tubing 22 is positioned as close as possible to the aluminum sleeve 24. When applying the restraint system 10 the user should always work from the horse's left side as when bridling. Next, the cable 12 is positioned over the horse's head just behind the ears. The user must then grasp the plastic tubing 22, with the left hand, and place the plastic tubing under the upper lip of the horse. The terms "under the upper lip" as used herein refer to the region under the animal's upper lip and above the upper front teeth at about the juncture between the gum and the upper lip as illustrated in FIG. 1. The plastic tubing 22 provides a non-abrasive outermost surface for the portion of the cord 18 which is placed under the upper lip of the animal and prevents cuts and abrasions to the animal's gums and upper lip that may be caused by the bare cord 18. Also, the plastic tubing 22, which surrounds the portion of the cord 18 positioned under the animal's upper lip, is slidably movable relative to the cord 18 to thereby ensure that the plastic tubing 22 will always be positioned under the horse's upper lip even as a user adjusts the pressure applied behind the horse's ears and under the horse's upper lip.

While holding the plastic tubing 22 in position under the horse's upper lip, the user must then begin to slowly pull on the handle 40 in order to take any slack out of the restraint system 10. Once the slack has been taken out of the restraint system 10 and the desired amount of pressure is being applied to the areas under the horse's upper lip and behind the horse's ears, the cord stop 42 is slidably moved along the cord 18 until the cord stop is as close to the double pulley 32 as possible. This step of sliding the stop 42 as close as possible to the double pulley 32, will ensure that the desired mount of pressure is continuously applied to the areas under the horse's upper lip and behind the horse's ears, even when the handle 40 is released. The mounting of the restraint system 10 to the horse's head is now completed.

The restraint system 10 should fit the horse's head snugly. The user can vary the pressure as necessary to get the desired response from the animal. Should it become necessary to apply more pressure to the areas under the horse's upper lip and behind the horse's ears in order to control the horse, the applied pressure can be increased simply by pulling on the handle 40 and sliding the stop 42 closer to the double pulley 32. To take off the restraint system 10, the cord stop 42 is slidably moved toward the handle 40, thus loosening the restraint system 10 and allowing the cable 12 to be moved over the ears which in turn allows the restraint system 10 to slide off of the horse's head.

If the horse is extra sensitive around the ears or head, the restraint system 10 is designed to allow an alternative method of mounting. This alternative method is performed by first opening the snap hook 30 in order to open up the restraint system 10. The restraint system 10 is then placed around the horse's neck and the snap hook 30 is reattached to the loop 14. Next, cable 12 is positioned behind the ears while the plastic tubing 22 is placed under the upper lip of the horse. The restraint system 10 is then secured to the horse's head in the same manner as was described previously.

The restraint system 10 allows just one person to restrain the equine athlete while at the same time allowing the same person to lead, hold, saddle, or load the horse. Conventional twitches require at least two people to allow the performance of the same tasks. The plastic covering the cable 12 is color coded, which each color signifying the size of horses for which the particular device 10 is suited for. As an example, the color black may mean that the particular device 10 is suited for miniature horses, the color blue may mean that the particular device 10 is suited for small horses, the color yellow may mean that the particular device 10 is suited for medium sized horses, the color red may mean that the particular device 10 is suited for large horses, and the color orange may mean that the particular device 10 is suited for extra large horses such as draft horses. The reason that the size of the cable 12 is important is that for best results the cable 12 should preferably be dimensioned such that each of the heat shrinkable tubes 16 and 20, which cover the crimped ends of the cable 12, fits into a respective one of the depressions directly behind the animal's ears. The heat shrinkable tubes 16 and 20 covering the crimped ends of the cable 12, form "bulges" or "knobs" which press on and intensify the stimulation of the T.H. 17 acupuncture points which are located at the depressions directly behind the animal's ears. When the T.H. 17 acupuncture points are stimulated endorphins are released which have a sedative or soporific action. Endorphins are narcotic-like substances produced in and released from the nervous system and the endorphins block nerve impulses signalling pain from other parts of the body, thus allowing the animal to relax. The plastic tube 22 applies pressure to the G.V. 26 acupuncture point, located under the animal's upper lip and above the upper front teeth at about the juncture between the gum and the upper lip, which causes adrenalin release. With constant pressure on the G.V. 26 acupuncture point, the G.V. 26 acupuncture point is over stimulated which creates a blockage and a subsequent sedative effect. Thus, the restraint system 10, by applying pressure to the nerves under the upper lip and behind the ears of the animal, causes a sedative effect on the animal. This sedative or calming effect can be intensified or more quickly induced by intermittent pulling and releasing of the cord 18. Once the animal is calm, constant pressure can be applied to the previously described nerve centers using the cord stop 42. Application of constant pressure using the cord stop 42 continues to keep the animal calm while leaving the user's hands free to perform the desired procedures on the animal. It has been found that using the device 10 can obviate the need for tranquilizing drugs during many veterinary procedures.

Because of its unique dual pressure point design, the restraint system 10 applies steady pressure to vital sensory nerve centers and can be used to calm the animal without inflicting pain. With pressure being applied to the nerves under the upper lip and behind the ears of the animal, the restraint system 10 distracts the animal's attention from other parts of its body that are being worked on. Once put on, the restraint system 10 is securely held in place and will not fall off.

Adjusting the size of the restraint system 10 is also very simple to accomplish. To shorten the size of the restraint 10, the sleeve 24 is moved away from the single pulley 28 leaving excess cord in the loop of cord passing through the eye of the swivel 26. The desired amount of the excess cord is taken up by pulling cord 18 through the second barrel or side of the sleeve 24. The sleeve 24 is then again pushed snugly against the single pulley 28.

To enlarge the restraint system 10, the cord 18 is pulled through the second barrel or side of the sleeve 24 in a direction toward the single pulley swivel 26. Then the slack is taken up by pulling cord 18 through the first barrel or side of the sleeve 24 in a direction toward the plastic tubing 22. This action simultaneously brings the sleeve 24 back snugly against the single pulley 28, in addition to enlarging the restraint system 10.

It is to be understood that the present invention is not limited to the embodiment described above, but encompasses any and all embodiments within the scope of the following claims.

I claim:

1. An equine restraint system comprising:

a first portion dimensioned and configured to fit behind a horse's ears;

a second portion dimensioned and configured to fit under the horse's upper lip;

means for controlling pressure applied between said first portion and said second portion, said means for controlling pressure including at least one pulley;

a cord passing through said at least one pulley terminating in a free end, said cord having a portion extending between said at least one pulley and said free end, said portion of said cord extending between said at least one pulley and said free end having a length which can be varied by a user in order to control pressure applied between said first portion and said second portion; and means for releasably fixing the length of said portion of said cord extending between said at least one pulley and said free end at a user selected length to thereby maintain pressure applied between said first portion and said second portion at a user selected level, without the need for a user to continuously pull on said portion of said cord extending between said at least one pulley and said free end, when the equine restraint system is being applied to the horse's head.

2. The equine restraint system according to claim 1, wherein said means for releasably fixing the length of said portion of said cord extending between said at least one pulley and said free end is a cord stop supported by said cord, intermediate said at least one pulley and said free end, said cord stop being releasably, frictionally engaged to said cord.

3. The equine restraint system according to claim 2, wherein said cord stop comprises:

an outer sleeve having a longitudinal axis, a longitudinally extending first bore, a closed end, an open end, and first and second holes in registry with one another and located along an axis perpendicular to said longitudinal axis;

a spring member received longitudinally within and slidably supported by said first bore of said outer sleeve; and a button member received longitudinally within and slidably supported by said first bore of said outer sleeve and positioned in abutting contact with the said spring member, said button member having a second bore extending perpendicular to the longitudinal axis of said outer sleeve and extending through said button member, said cord passing through said first and second holes and said second bore, said second bore being brought into alignment with said first and second holes to allow said cord stop to be slidably moved along said cord by a user depressing said button member, and said cord being frictionally gripped between said second bore and said first and second holes when said button member is released to thereby releasably, frictionally fix said cord stop along said cord.

4. An equine restraint system comprising:

a first portion dimensioned and configured to fit behind a horse's ears;

a second portion including a second cord portion and a length of plastic tubing surrounding said second cord portion, said plastic tubing being slidably movable relative to said second cord portion to thereby ensure that said plastic tubing can remain positioned under the horse's upper lip even as a user adjusts a pressure applied between said first portion and said second portion, said plastic tubing preventing cuts and abrasions to the horse's upper lip and gum;

means for controlling pressure applied between said first portion and said second portion, said means for controlling pressure including at least one pulley; and a cord passing through said at least one pulley terminating in a free end, said cord having a portion extending between said at least one pulley and said free end, said portion of said cord extending between said at least one pulley and said free end having a length which can be varied by a user in order to control pressure applied between said first portion and said second portion.

5. An equine restraint system for application to a horse having particularly sensitive points located behind each ear of the horse, these sensitive points being capable of endorphin production when properly stimulated, the equine restraint system comprising:

a first portion dimensioned and configured to fit behind the horse's ears and having a length, said first portion having a pair of bulges positioned along the length thereof, each of said pair of bulges being positioned to press upon a respective one of the particularly sensitive points located behind each ear of the horse;

a second portion dimensioned and configured to fit under the horse's upper lip;

means for urging said first and second portions toward one another to thereby simultaneously apply pressure behind the horse's ears and under the horse's upper lip, said means for urging said first and second portions toward one another including at least one pulley; and a cord passing through said at least one pulley terminating in a free end, said cord having a portion extending between said at least one pulley and said free end, said portion of said cord extending between said at least one pulley and said free end having a length which can be varied by a user in order to control pressure applied behind the horse's ears and under the horse's upper lip.

* * * * *